US008673408B2

(12) United States Patent
Yorozuya

(10) Patent No.: US 8,673,408 B2
(45) Date of Patent: Mar. 18, 2014

(54) PLASMA FILM DEPOSITION METHOD

(75) Inventor: Shunichi Yorozuya, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 238 days.

(21) Appl. No.: 13/117,854

(22) Filed: May 27, 2011

(65) Prior Publication Data

US 2011/0300309 A1 Dec. 8, 2011

(30) Foreign Application Priority Data

Jun. 2, 2010 (JP) ..... 2010-126763

(51) Int. Cl.
*H05H 1/00* (2006.01)
*B05D 3/14* (2006.01)
*H05H 1/24* (2006.01)

(52) U.S. Cl.
USPC ..... 427/569; 427/562; 427/563; 427/535

(58) Field of Classification Search
USPC ..... 427/384, 385.5, 475, 483, 484, 487, 427/488, 489, 490, 491, 492, 535, 536, 561, 427/562, 563, 569
See application file for complete search history.

(56) References Cited

U.S. PATENT DOCUMENTS

| | | | | |
|---|---|---|---|---|
| 4,212,719 | A * | 7/1980 | Osada et al. | 204/165 |
| 6,448,190 | B1 * | 9/2002 | Hayashi et al. | 438/778 |
| 6,800,336 | B1 | 10/2004 | Fornsel et al. | |
| 7,455,892 | B2 | 11/2008 | Goodwin et al. | |
| 7,799,389 | B2 | 9/2010 | Borra et al. | |
| 2005/0129859 | A1 * | 6/2005 | Misev et al. | 427/384 |
| 2006/0286815 | A1 | 12/2006 | Aoi | |
| 2007/0065596 | A1 | 3/2007 | Koulik et al. | |
| 2007/0264508 | A1 | 11/2007 | Gabelnick et al. | |
| 2008/0286492 | A1 | 11/2008 | Gasworth | |

FOREIGN PATENT DOCUMENTS

| | | | |
|---|---|---|---|
| CN | 1955332 | A | 5/2007 |
| JP | 06-002149 | A | 1/1994 |
| JP | 4082905 | B2 | 4/2003 |
| JP | 2004-510571 | T | 4/2004 |
| JP | 2007-031550 | A | 2/2007 |
| JP | 2008-504442 | T | 2/2008 |
| JP | 4082905 | B2 | 4/2008 |
| JP | 2008-518109 | T | 5/2008 |

OTHER PUBLICATIONS

Uwe Lommatzsch et al., "Plasma Polymerization of HMDSO With an Atmospheric Pressure Plasma Jet for Corrosion Protection of Aluminum and Low-Adhesion Surfaces", Plasma Processes and Polymers, vol. 6, No. 10, Oct. 14, 2009, pp. 642-648, XP55006365, ISSN:1612-8850, DOI: 10.1002/ppap.200900032 * the whole document *.

* cited by examiner

*Primary Examiner* — Michael Wieczorek
(74) *Attorney, Agent, or Firm* — Carrier Blackman & Associates, P.C.; Joseph P. Carrier; William D. Blackman

(57) ABSTRACT

A plasma nozzle supplies a plasmatized electric discharge gas, and a first supply section in a flow regulator which is interposed between the plasma nozzle and a base member supplies a first liquid-phase raw material. A second supply section which is separate from the first supply section supplies a second liquid-phase raw material. The first liquid-phase raw material which is activated by a plasmatized electric discharge gas and deposited on the base member while in a liquid phase is caused to interact with the second liquid-phase raw material which is activated by the plasmatized electric discharge gas, and solidified into a film on the base member.

8 Claims, 4 Drawing Sheets

FIG. 4

| No. | | INVENTIVE EXAMPLES | | COMPARATIVE EXAMPLES | | | |
|---|---|---|---|---|---|---|---|
| | | 1 | 2 | 1 | 2 | 3 | 4 |
| SUPPLIED SUBSTANCES | $O_2$ | × | ○ | × | × | ○ | ○ |
| | HEXAMETHYLDISILOXANE | ○ (FIRST NOZZLE) | ○ (FIRST NOZZLE) | ○ *1 (FIRST NOZZLE) | ○ *2 (SECOND NOZZLE) | × | ○ *2 (SECOND NOZZLE) |
| | DECAMETHYLCYCLOPENTASILOXANE | ○ (SECOND NOZZLE) | ○ (SECOND NOZZLE) | ○ *1 (FIRST NOZZLE) | ○ *2 (SECOND NOZZLE) | ○ (SECOND NOZZLE) | ○ *2 (SECOND NOZZLE) |
| RATE OF FILM DEPOSITION [μm/min] | | 1.2 | 1.5 | 0.2 | 0.5 | 0.6 | 0.7 |
| COLLECTED AMOUNT OF DECAMETHYLCYCLOPENTASILOXANE [g/min] | | 2.9 | 1.8 | 8.8 | 6.3 | 5.7 | 5.4 |

*1 : INTRODUCED FROM FIRST NOZZLE AFTER BEING MIXED

*2 : INTRODUCED FROM SECOND NOZZLE AFTER BEING MIXED

PLASMA FILM DEPOSITION METHOD

CROSS-REFERENCE TO RELATED APPLICATION

This application is based upon and claims the benefit of priority from Japanese Patent Application No. 2010-126763 filed on Jun. 2, 2010, of which the contents are incorporated herein by reference.

BACKGROUND OF THE INVENTION

1. Field of the Invention

The present invention relates to a plasma film deposition method for depositing a film on the surface of a base member through the interaction of a first liquid-phase raw material and a second liquid-phase raw material.

2. Description of the Related Art

It has been the general practice in the art of film deposition to deposit films such as protective films, functional films, etc. on the surface of base members made of plastic, metal, or ceramics. Plasma film deposition technology that uses plasma has heretofore been known as one of the film deposition processes.

Plasma film deposition is carried out by a plasma film deposition apparatus which includes a chamber provided with a high-vacuum pump, etc. Recently, it has been proposed to perform a plasma film deposition process under the atmospheric pressure. For example, Japanese Laid-Open Patent Publication No. 06-002149 discloses a technology for supplying a gas-phase film deposition raw material (gas-phase raw material) to a plasma generated on the surface of a base member and polymerizing the gas-phase raw material which is activated into a film deposited on the surface of the base member.

Japanese Patent No. 4082905 discloses a technology for polymerizing a gas-phase raw material with a plasma generated in a plasma generating apparatus and bringing the polymerized gas-phase raw material into contact with a base member to deposit a film thereon.

Each of the technologies disclosed in Japanese Laid-Open Patent Publication No. 06-002149 and Japanese Patent No. 4082905 uses a gas-phase raw material. However, only part of the gas-phase raw material contributes to film deposition, and most of the gas-phase raw material is carried and discharged by a plasmatized electric discharge gas. Consequently, the rate of film deposition is low, and the efficiency with which the gas-phase raw material is used is low.

It is also known to use a liquid-phase film deposition raw material (liquid-phase raw material). For example, Japanese Laid-Open Patent Publication No. 2007-031550 discloses a technology for mixing a liquid-phase raw material which has been ultrasonically atomized with a gas to produce a mixed mist, and plasmatizing the mixed mist. When the mixed mist is plasmatized, the gas serves as a plasmatized electric discharge gas (excited species), and the liquid-phase raw material is activated.

Japanese Laid-Open Patent Publication No. 2008-504442 (PCT) discloses a technology for electrohydrodynamically spraying a liquid-phase raw material onto a substrate and reacting excited species (a plasmatized electric discharge gas or a gas-phase raw material) which are produced by a plasma or the like.

According to the technologies disclosed in Japanese Laid-Open Patent Publication No. 2007-031550 and Japanese Laid-Open Patent Publication No. 2008-504442 (PCT), it is difficult to control the ratio of the supplied liquid-phase raw material and the excited species which could interact with the liquid-phase raw material. If the excited species run short, then the liquid-phase raw material is activated insufficiently.

On the other hand, if the excited species are excessive, then the liquid-phase raw material is activated excessively. In this case, if the liquid-phase raw material is polymerizable, then its polymerization progresses in a short time, tending to produce minute particles that remain on the film. The minute particles on the film make the appearance of the film poor, and are likely to prevent the film from performing its desired functions.

If the ratio of the liquid-phase raw material and the excited species is a balanced ratio in order to avoid the above difficulties, then it is not easy to increase the rate of film deposition.

SUMMARY OF THE INVENTION

It is a general object of the present invention to provide a plasma film deposition method which makes it easy to control the ratio of a liquid-phase raw material and excited species.

A major object of the present invention is to provide a plasma film deposition method which is capable of increasing the rate of film deposition.

According to the present invention, there is provided a plasma film deposition method comprising the step of depositing a film on a surface of a base member by causing a first liquid-phase raw material and a second liquid-phase raw material, which are activated by a plasma, to interact with each other. For example, the plasma film deposition method is carried out by the steps of supplying a plasmatized electric discharge gas from a plasma nozzle and supplying the first liquid-phase raw material from a first supply section in a flow regulator which is interposed between the plasma nozzle and the base member, supplying the second liquid-phase raw material from a second supply section which is separate from the first supply section, and forming a film on the base member by causing the first liquid-phase raw material which is activated by the plasmatized electric discharge gas and deposited on the base member while in a liquid phase, to interact with the second liquid-phase raw material which is activated by the plasmatized electric discharge gas.

The first liquid-phase raw material which has reached an area to be deposited interacts with the activated second liquid-phase raw material, and hence is polymerized and solidified in a relatively short time. The first liquid-phase raw material is thus prevented from being volatilized.

Specifically, the first liquid-phase raw material is kept in the liquid phase while being supplied, and is deposited on the area to be deposited. Thereafter, the first liquid-phase raw material is solidified by interacting with the activated second liquid-phase raw material. As the efficiency of the reaction increases, the amount of the film deposition raw materials which are unreacted and discharged without contributing to film deposition is reduced.

Furthermore, the second liquid-phase raw material is supplied from the second supply section which is different from the first supply section which supplies the first liquid-phase raw material. Consequently, the rate at which the second liquid-phase raw material is supplied can be adjusted separately from the rate at which the first liquid-phase raw material is supplied. The rate at which the first liquid-phase raw material is solidified, or preferably, the rate at which the first liquid-phase raw material is polymerized, can be as high as possible within a range in which no minute particles are produced. Stated otherwise, the rate of film deposition can be increased. The second liquid-phase raw material is activated by the plasmatized electric discharge gas.

Preferably, the first liquid-phase raw material comprises a substance whose vapor pressure is lower than that of the second liquid-phase raw material, under the atmospheric pressure at 25° C. The first liquid-phase raw material which comprises such a substance is easily prevented from being volatilized.

The plasmatized electric discharge gas may comprise a plasmatized inactive gas, or may comprise a plasmatized gas-phase raw material comprising a gas having atoms which interact with at least one of the first liquid-phase raw material and the second liquid-phase raw material. In such a case, it is possible to deposit a film containing atoms of the gas-phase raw material.

The plasmatized gas-phase raw material may be mixed with a plasmatized inactive gas. In other words, such a plasmatized mixed gas may be supplied as the plasmatized electric discharge gas.

The above and other objects, features, and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 4 is a diagram showing rates of film deposition and amounts of decamethylcyclopentasiloxane (first liquid-phase raw material) collected in a cooling trap in Inventive Examples 1, 2 and Comparative Examples 1 through 4.

DESCRIPTION OF THE PREFERRED EMBODIMENTS

Plasma film deposition methods according to preferred embodiments of the present invention will be described in detail below with reference to the accompanying drawings.

Figure 1:
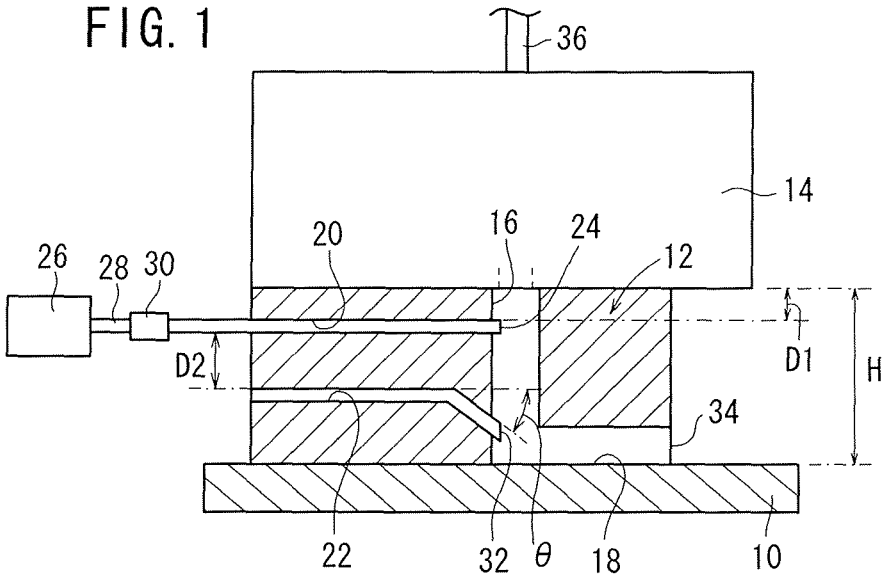
FIG. 1 is a sectional front elevational view of a plasma film deposition apparatus for carrying out a plasma film deposition method according to an embodiment of the present invention.

A plasma film deposition apparatus for carrying out a plasma film deposition method according to an embodiment of the present invention will first be described below with reference to FIG. 1, which is a sectional front elevational view of the plasma film deposition apparatus. As shown in FIG. 1, the plasma film deposition apparatus, which serves to deposit a film on a base member 10, comprises a flow regulator 12 disposed in covering relation to an area to be deposited of the base member 10, and a plasma generating apparatus including a plasma nozzle 14 connected to the flow regulator 12. The flow regulator 12 is interposed between the base member 10 and the plasma nozzle 14, and has a height H which is set to 10 mm, for example.

The base member 10, which is an object to be deposited with a film, is in the form of a planar member having a flat upper end face, and is made of plastic, metal, ceramics, or the like. Alternatively, the base member 10 may be made of wood, stone, or the like. Specific preferred materials of the base member 10 may be glass, iron, etc.

The flow regulator 12, which covers a predetermined area to be deposited on an end face of the base member 10, serves to guide a plasmatized electric discharge gas and a film deposition raw material to reach the area to be deposited, and also to produce a flow of the plasmatized electric discharge gas and the film deposition raw material, which is not reacted, away from the area to be deposited. The flow regulator 12 includes a confluent supply passage 16 extending vertically from the plasma nozzle 14 to the area to be deposited of the base member 10, and a discharge passage 18 extending from the area to be deposited to a discharge port 34.

The flow regulator 12 also includes a first supply passage 20 and a second supply passage 22 defined therein which extend from a left end face of the flow regulator 12 in FIG. 1 to the confluent supply passage 16. The first supply passage 20 and the second supply passage 22 extend horizontally parallel to each other in the flow regulator 12. The upstream side of the confluent supply passage 16 is positioned near the plasma nozzle 14, while the downstream side of the confluent supply passage 16 is positioned near the base member 10.

The first supply passage 20 has an open end disposed in the confluent supply passage 16 and fitted with a first nozzle 24 which extends to a substantially central region in the confluent supply passage 16. The plasma nozzle 14 has an outlet which is open into the confluent supply passage 16 and which is spaced upwardly from the first nozzle 24 by a distance D1 of about 1 mm, for example.

The first supply passage 20 has an opposite open end which is open out of the flow regulator 12 and which is connected to a supply device 26 for supplying a second liquid-phase raw material. The second liquid-phase raw material which is supplied from the supply device 26 flows through a first supply pipe 28 connected between the supply device 26 and the first supply passage 20, and is introduced through the first supply passage 20 into the confluent supply passage 16 in the flow regulator 12.

The first supply pipe 28 has a first flow rate controller 30 of known nature. The first flow rate controller 30 can adjust the rate at which the second liquid-phase raw material flows through the first supply pipe 28.

The second supply passage 22 has an open end disposed in the confluent supply passage 16 and fitted with a second nozzle 32 which extends into the confluent supply passage 16. The second nozzle 32 is inclined toward the area to be deposited that is positioned below the second nozzle 32. In FIG. 1, the second nozzle 32 is inclined preferably at an angle θ of about 45° from the axis of the second supply passage 22.

The second supply passage 22 has an opposite open end which is open out of the flow regulator 12 and which is connected to a sprayer, not shown. The sprayer ejects a first liquid-phase raw material, which is a primary film deposition raw material, as a mist, or stated otherwise, as minute droplets, which flow through a second supply pipe, not shown, connected to the sprayer and the second supply passage 22, and are then introduced into the confluent supply passage 16.

The first supply passage 20 has a lower end which is spaced from the upper end of the second supply passage 22 by a distance D2 of about 6 mm, for example. In other words, the first supply passage 20 and the second supply passage 22 are vertically spaced from each other by a distance of about 6 mm.

The discharge passage 18 extends horizontally, and discharges an electric discharge gas, which is the inactivated plasmatized electric discharge gas, and an unreacted film deposition raw material from the discharge port 34 at an open end of the discharge passage 18.

The plasma nozzle 14 is mounted on the flow regulator 12 which is basically constructed as described above.

The plasma nozzle 14 is supplied with a gas-phase raw material for generating a plasmatized electric discharge gas, an inactive gas, or a mixture of a gas-phase raw material and an inactive gas, through a gas line 36. In the plasma nozzle 14, the gas-phase raw material, the inactive gas, or the mixture thereof is plasmatized by a plasma generating mechanism, not shown. The gas is then discharged from the plasma nozzle 14 as a plasmatized electric discharge gas. The plasma generating apparatus including the plasma nozzle 14 for discharging a plasma is known in the art, and will not be described in detail below.

A connection line, which connects the plasma nozzle 14 to a source of a gas-phase raw material, includes a second flow rate controller, not shown, for adjusting the rate at which the gas-phase raw material flows.

A plasma film deposition method according to the present embodiment will be described below in relation to operation of the plasma film deposition apparatus described above. It is assumed that the plasma nozzle 14 supplies a plasmatized mixed gas, which is produced when the mixture referred to above is plasmatized, as a plasmatized electric discharge gas, and that the sprayer connected to the second supply passage 22 supplies a substance (e.g., siloxane) which is a monomer, an oligomer, or a polymer and is in a liquid phase at normal temperature under normal pressure, as the first liquid-phase raw material.

For depositing a film on the base member 10, an inactive gas such as helium, argon, or the like is dried to remove water therefrom. The dried inactive gas is supplied through the gas line 36 to the plasma nozzle 14. A gas-phase raw material is supplied through the gas line 36 to the plasma nozzle 14 and mixed with the dried inactive gas. Therefore, a mixed gas which is a mixture of the dried inactive gas and the gas-phase raw material is produced.

The gas-phase raw material comprises a gas containing atoms that can be bonded to Si atoms and/or C atoms which are contained in siloxane as the first liquid-phase material. A specific example of such a gas may be oxygen, nitrogen, or air.

The mixed gas is plasmatized by the plasma generating mechanism in the plasma nozzle 14. The plasma nozzle 14 thus supplies a plasmatized mixed gas which is made from the dried inactive gas and the gas-phase raw material to the confluent supply passage 16.

The supply device 26 supplies a second liquid-phase raw material which, when activated by the plasmatized mixed gas, can be bonded to at least either Si atoms and C atoms which are contained in siloxane as the first liquid-phase material or the gas-phase raw material.

The second liquid-phase raw material should preferably be a material which is in a liquid phase under the atmospheric pressure at 25° C. and which has a substance including two or more atoms providing a skeleton, e.g., a C—C bond, an Si—Si bond, an Si—O bond, or a C—S bond. Preferred examples of the second liquid-phase raw material include dimethylsiloxane, hexamethyldisiloxane, cyclic siloxane, silsesquioxane, siloxane having a Si—H bond, methanol, low-molecular thiol, etc. Alternatively, the second liquid-phase raw material may be a substance disclosed in Japanese Laid-Open Patent Publication 2004-510571 (PCT), paragraph [0011] or an organic silicon compound disclosed in Japanese Laid-Open Patent Publication 2008-518109 (PCT), paragraphs [0024], [0025]. A compound including two or more Si—O bonds is particularly preferable as the second liquid-phase raw material.

The second liquid-phase raw material flows through the first supply pipe 28, the first supply passage 20, and the first nozzle 24 into the confluent supply passage 16, in which the second liquid-phase raw material joins the plasmatized mixed gas from the plasma nozzle 14. When the second liquid-phase raw material joins the plasmatized mixed gas, the second liquid-phase raw material volatilizes and is activated by the plasmatized mixed gas. The activated second liquid-phase raw material is carried by the plasmatized mixed gas toward the area to be deposited.

The sprayer supplies an atomized first liquid-phase raw material through the second supply passage 22 to the confluent supply passage 16. According to the present embodiment, therefore, the plasmatized mixed gas which includes the activated gas-phase raw material, the second liquid-phase raw material, and the first liquid-phase raw material are introduced successively in the order named along the downstream direction into the confluent supply passage 16.

The first liquid-phase raw material comprises a substance whose vapor pressure is lower and which is less volatile than the second liquid-phase raw material, under the atmospheric pressure at 25° C. Specifically, the first liquid-phase raw material may comprise a substance whose molecular weight is greater than that of the second liquid-phase raw material, e.g., decamethylcyclopentasiloxane, which is a type of cyclic siloxane, silsesquioxane, or the like. Cyclic siloxane is particularly preferable. These substances are not reactive themselves under the atmospheric pressure at 25° C.

The first liquid-phase raw material, while being minute droplets, is activated by an inactive gas or the gas-phase raw material that has been activated which is contained in the plasmatized mixed gas, and a radical which is produced when the energy level of the plasmatized mixed gas is lowered. The first liquid-phase raw material in the activated state reaches the area to be deposited of the base member 10 and is deposited thereon. In other words, the first liquid-phase raw material while in a liquid phase is activated by the plasmatized mixed gas and is deposited on the area to be deposited. After being deposited, the first liquid-phase raw material keeps activated by the plasmatized mixed gas, the radical, etc. that reach the area to be deposited.

Thereafter, the first liquid-phase raw material is further activated by the plasmatized mixed gas and the second liquid-phase raw material, and polymerized by molecules contained in the gas-phase raw material which is contained in and activated by the plasmatized mixed gas and the second liquid-phase raw material. In other words, the first liquid-phase raw material is polymerized by an interaction with the second liquid-phase raw material and the gas-phase raw material. The deposited first liquid-phase raw material is solidified by the polymerization, forming a film made of a polymer having a structure (e.g., an Si—O bond) wherein the molecular structure of the first liquid-phase raw material is bonded by the molecular structure of the second liquid-phase raw material.

According to the present embodiment, as described above, the first liquid-phase raw material is supplied to the area to be deposited while it is kept in the liquid phase, and the first liquid-phase raw material which reaches the area to be deposited and which is activated is solidified into a film by an interaction with the activated gas-phase raw material and the second liquid-phase raw material. Consequently, the proportion of an unreacted film deposition raw material which is discharged to the discharge port 34 without contributing to the formation of the film is smaller than if the film is formed using only the gas-phase raw material.

Since the first liquid-phase raw material which is deposited in the liquid phase is solidified by an interaction with a substance that is bonded and integrated by an interaction between the second liquid-phase raw material and the gas-phase raw material, the first liquid-phase raw material is prevented from being volatilized.

For the above reasons, the efficiency with which the film deposition raw materials are used is highly increased. Therefore, the cost of materials used is lowered, and a saving of natural resources is easily achieved.

According to the related-art technologies disclosed in Japanese Patent No. 4082905, Japanese Laid-Open Patent Publication No. 2007-031550, and Japanese Laid-Open Patent Publication No. 2008-504442 (PCT), molecules of a relatively low molecular weight, each containing 1 through 3 Si or C atoms are polymerized by atoms or molecules of a low molecular weight, each containing about 2 atoms, which are decomposed and excited by a plasma (Japanese Patent No. 4082905), or polymerized with molecules which are relatively easily reactive independently under the atmospheric pressure (Japanese Laid-Open Patent Publication No. 2007-031550), or polymerized by bonding species of atomic nucleus excited by a plasma or a radical to raw material molecules (Japanese Laid-Open Patent Publication No. 2008-504442 (PCT)). According to the present embodiment, in contrast, the first liquid-phase raw material which is not reactive under the atmospheric pressure is used as a chief component for polymerization, and is caused to interact with the second liquid-phase raw material of a relatively low molecular weight which is excited by a plasma while the first liquid-phase raw material is maintaining its major molecular structure. According to the present embodiment, therefore, since the first liquid-phase raw material is deposited while it is maintaining its major molecular structure, the rate of deposition and hence the rate of film deposition are higher than the related-art technology disclosed in Japanese Patent No. 4082905.

In addition, compared with the related-art technology disclosed in Japanese Laid-Open Patent Publication No. 2007-031550, the rate of reaction is increased since the molecules of the first liquid-phase raw material are not limited to one reactive point, and it is expected that a denser film can be formed since the number of cross-linkage points is increased.

Furthermore, according to the related-art technology disclosed in Japanese Laid-Open Patent Publication No. 2008-504442 (PCT), for example, if molecules to be polymerized undergo a large steric hindrance, then since it becomes difficult for excited species of atomic nucleus to be interposed between the molecules, the rate of polymerization is lowered or polymerization may not progress. Even if polymerization progresses, when excited species of atomic nucleus bond molecules to each other, they bond the molecules such that the intermolecular distance is a distance sandwiching one atom, tending to cause the film to shrink and crack.

According to the present embodiment, the second liquid-phase raw material which is of a molecular structure having two or more atoms providing a skeleton, rather than species of atomic nucleus, is excited to interact with the first liquid-phase raw material (molecules) which has formed reactive points by being excited. Consequently, even if the molecules of the first liquid-phase raw material undergoes a large steric hindrance or has a large intermolecular distance, it is easy to bond molecules to each other. Stated otherwise, it is easy to cross-link the first liquid-phase raw material with the second liquid-phase raw material, so that the rate of reaction can be increased, and the film is prevented from shrinking.

According to the present embodiment, moreover, the rates at which the second liquid-phase raw material and the gas-phase raw material are supplied can be controlled respectively by the first flow rate controller 30 and the second flow rate controller. Therefore, it is easy to control the degree of an interaction between the second liquid-phase raw material and the gas-phase raw material, and the first liquid-phase raw material. Stated otherwise, it is possible to establish a rate of film deposition for making the above polymerization progress in as short a time as possible while preventing minute particles from being formed.

According to the present embodiment, therefore, the rate of film deposition can be as high as possible, and a film which is aesthetically excellent and performs desired functions can be produced.

Furthermore, the present embodiment does not need a chamber which is widely used for plasma film deposition and a high-vacuum pump for evacuating such a chamber. Therefore, the cost of the plasma film deposition apparatus does not rise significantly.

After the film has been deposited as described above, if a film is to be deposited on another area of the base member 10, the flow regulator 12 is moved to the new area to be deposited to have the confluent supply passage 16 thereof face the new area to be deposited. By thus repeating the film deposition, it is possible to deposit a film on any desired area of the base member 10. In other words, a film can be deposited on the base member 10 without being limited by the shape and dimensions of the base member 10.

The present invention is not limited to the above embodiment, but various changes and modifications may be made thereto without departing from the scope of the invention.

For example, in the above embodiment, both the plasmatized gas-phase raw material and the second liquid-phase raw material are introduced into the confluent supply passage 16 where they are added to the first liquid-phase raw material. However, only the second liquid-phase raw material may be introduced into the confluent supply passage 16. In such a case, a plasmatized inactive gas may be supplied as the plasmatized electric discharge gas.

Alternatively, rather than supplying a plasmatized inactive gas, only a plasmatized gas-phase raw material may be supplied as the plasmatized electric discharge gas.

In the above embodiment, the first liquid-phase raw material is introduced by the sprayer into the confluent supply passage 16. Alternatively, the first liquid-phase raw material may be bubbled by a carrier gas, so that the carrier gas can accompany the first liquid-phase raw material into the confluent supply passage 16. Alternatively, the first liquid-phase raw material may be introduced into the confluent supply passage 16 by an appropriate delivery mechanism such as a pump or the like or an appropriate delivery medium such as an ultrasonic wave or the like.

The flow regulator 12 is not indispensable. Stated otherwise, the above plasma film deposition may be carried out without the need for the flow regulator 12.

The gas-phase raw material, the second liquid-phase raw material, and the first liquid-phase raw material are not limited to the substances referred to above. The gas-phase raw material and the second liquid-phase raw material may comprise suitable substances depending on the type of the first liquid-phase raw material.

EXAMPLES

Inventive Examples 1, 2

According to Inventive Example 1, a plasma film deposition apparatus which was constructed as shown in FIG. 1 and had a flow regulator 12 with the dimensions H=10 mm, D1=1 mm, D2=6 mm, θ=45°, and a polycarbonate board for use as the base member 10 were prepared. Helium was plasmatized by a plasma generating apparatus manufactured by Plasma Concept Tokyo, and introduced at a discharge rate of 100 cm/s from the plasma nozzle 14 into the confluent supply passage 16.

Hexamethyldisiloxane from the supply device 26 was supplied at a rate of 0.1 ml/cm$^2$/s through the first nozzle 24 to the confluent supply passage 16, and decamethylcyclopentasiloxane sprayed by the sprayer was supplied through the second nozzle 32 to the confluent supply passage 16. This film deposition was defined as in Inventive Example 1. In Inventive Example 1, only the second liquid-phase raw material (hexamethyldisiloxane) was added to the first liquid-phase raw material (decamethylcyclopentasiloxane).

Hexamethyldisiloxane and decamethylcyclopentasiloxane have the following structural formulas (1), (2), respectively:

(1)

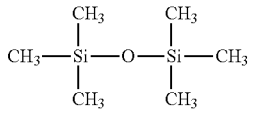

(2)

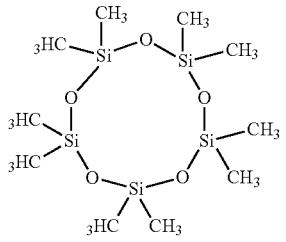

According to Inventive Example 2, helium was mixed with oxygen at a volumetric ratio of 98:2 (helium: oxygen), producing a mixed gas. The mixed gas was plasmatized and then introduced at a discharge rate of 100 cm/s from the plasma nozzle 14 into the confluent supply passage 16. Other conditions of Inventive Example 2 followed those of Inventive Example 1. In Inventive Example 2, therefore, the gas-phase raw material (oxygen) and the second liquid-phase raw material (hexamethyldisiloxane) were added to the first liquid-phase raw material (decamethylcyclopentasiloxane).

Comparative Examples 1 through 4

Figure 2:
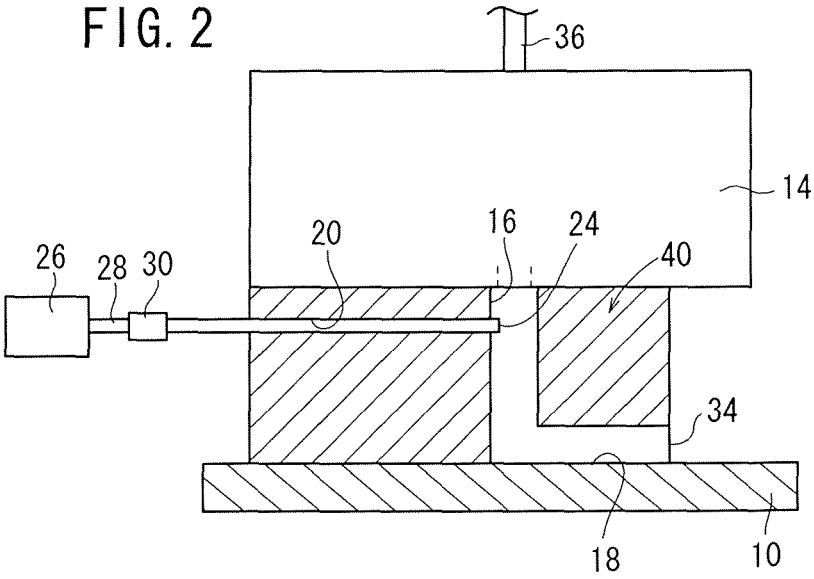
FIG. 2 is a sectional front elevational view of a plasma film deposition apparatus used to carry out Comparative Example 1.

According to Comparative Example 1, a plasma film deposition apparatus 40 shown in FIG. 2 was used to deposit a film. The plasma film deposition apparatus 40 was free of the sprayer, the second supply passage 22, and the second nozzle 32 of the flow regulator 12 shown in FIG. 1.

Hexamethyldisiloxane and decamethylcyclopentasiloxane were mixed with each other at a volumetric ratio of 1:1, producing a mixed liquid. The mixed liquid was supplied from the supply device 26 at a rate of 0.1 ml/cm$^2$/s through the first nozzle 24 to the confluent supply passage 16. Other conditions of Comparative Example 1 followed those of Inventive Example 1. In Comparative Example 1, therefore, the first liquid-phase raw material and the second liquid-phase raw material were simultaneously ejected from the first nozzle 24 into the confluent supply passage 16.

Figure 3:
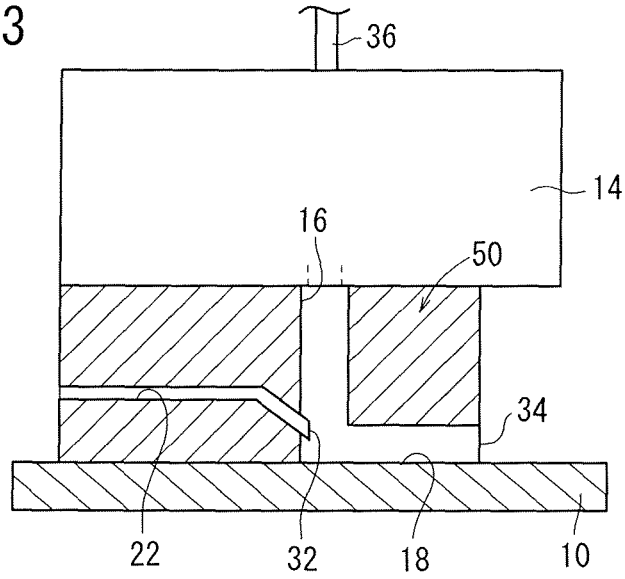
FIG. 3 is a sectional front elevational view of a plasma film deposition apparatus used to carry out Comparative Examples 2 through 4.

According to Comparative Example 2, a plasma film deposition apparatus 50 shown in FIG. 3 was used to deposit a film. The plasma film deposition apparatus 50 was free of the supply device 26, the first supply passage 20, and the first nozzle 24 of the flow regulator 12 shown in FIG. 1. A mixed liquid of hexamethyldisiloxane and decamethylcyclopentasiloxane was supplied from the sprayer through the second nozzle 32 to the confluent supply passage 16. Other conditions of Comparative Example 2 were similar to those of Comparative Example 1. In Comparative Example 2, therefore, the first liquid-phase raw material and the second liquid-phase raw material were simultaneously ejected from the second nozzle 32 into the confluent supply passage 16.

According to Comparative Example 3, the plasma film deposition apparatus 50 shown in FIG. 3 was used to deposit a film, and hexamethyldisiloxane was not supplied. Other conditions of Comparative Example 3 were similar to those of Inventive Example 2. In Comparative Example 3, therefore, only the first liquid-phase raw material was introduced through the second nozzle 32 into the confluent supply passage 16, and only the gas-phase raw material (oxygen) was added to the first liquid-phase raw material.

According to Comparative Example 4, the plasma film deposition apparatus 50 shown in FIG. 3 was used to deposit a film, and plasmatized $O_2$ was supplied from the plasma nozzle 14. Other conditions of Comparative Example 4 were similar to those of Comparative Example 2. In Comparative Example 4, the gas-phase raw material was supplied from the plasma nozzle 14, and the first liquid-phase raw material and the second liquid-phase raw material were simultaneously ejected from the second nozzle 32 into the confluent supply passage 16.

In all of Inventive Examples 1, 2 and Comparative Examples 1 through 4, the discharge port 34 was fitted with a cooling trap (not shown). The cooling trap serves to cool the electric discharge gas (the inactivated plasmatized electric discharge gas) discharged from the discharge port 34 to condense or freeze and collect decamethylcyclopentasiloxane (first liquid-phase raw material) contained in the electric discharge gas.

Inventive Examples 1, 2 and Comparative Examples 1 through 4 were checked for rates of film deposition and amounts of decamethylcyclopentasiloxane collected by the cooling trap. The results are shown in FIG. 4. It can be seen from FIG. 4 that the rates of film deposition in Inventive Examples 1, 2 are higher than the rates of film deposition in Comparative Examples 1 through 4, and the collected amounts of decamethylcyclopentasiloxane in Inventive Examples 1, 2 are smaller than the collected amounts of decamethylcyclopentasiloxane in Comparative Examples 1 through 4. According to Inventive Examples 1, 2 based on the above embodiment, therefore, the rate of film deposition is increased, and the efficiency with which decamethylcyclopentasiloxane (first liquid-phase raw material) is used is increased.

Although certain preferred embodiments of the present invention have been shown and described in detail, it should be understood that various changes and modifications may be made therein without departing from the scope of the appended claims.

What is claimed is:

1. A plasma film deposition method for depositing a film on a surface of a base member by causing a first liquid-phase raw material and a second liquid-phase raw material, which are both activated by a plasma, to interact with each other, wherein the second liquid-phase raw material comprises a substance different from that of the first liquid-phase raw material, the plasma film deposition method comprising the steps of:

depositing the first liquid-phase raw material on the surface of the base member while the first liquid-phase raw material is activated by a plasmatized electric discharge gas and kept in a liquid phase, and supplying the second liquid-phase raw material activated by the plasmatized electric discharge gas to the first liquid-phase raw material deposited on the surface of the base member, in order to cause the first liquid-phase raw material and the second liquid-phase raw material to interact with each other for depositing the film.

2. The plasma film deposition method according to claim 1, wherein the first liquid-phase raw material comprises a substance whose vapor pressure is lower than that of the second liquid-phase raw material, under atmospheric pressure at 25° C.

3. The plasma film deposition method according to claim 1, wherein the plasmatized electric discharge gas for activating the first liquid-phase raw material and the second liquid-phase raw material comprises a plasmatized gas-phase raw material comprising a gas having at least atoms which interact with at least one of the first liquid-phase raw material and the second liquid-phase raw material.

4. The plasma film deposition method according to claim 3, wherein the plasmatized electric discharge gas comprises a mixed gas of the plasmatized gas-phase raw material and a plasmatized inactive gas.

5. The plasma film deposition method according to claim 1, wherein the first liquid-phase raw material includes a cyclic siloxane or silsesquioxane.

6. The plasma film deposition method according to claim 1, wherein the first liquid-phase raw material is cross-linked in the deposited film.

7. The plasma film deposition method according to claim 1, wherein the second liquid-phase raw material is also volatilized by the plasmatized electric discharge gas.

8. The plasma film deposition method according to claim 1, wherein in the depositing step the first liquid-phase raw material is supplied in minute droplets.

* * * * *